United States Patent [19]

Cadle et al.

[11] 4,198,234

[45] Apr. 15, 1980

[54] SINTERED METAL ARTICLES

[75] Inventors: Terence M. Cadle; Martyn S. Lane; Trevor K. Johnson, all of Coventry, England

[73] Assignee: Brico Engineering, Coventry, England

[21] Appl. No.: 414,953

[22] Filed: Nov. 12, 1973

Related U.S. Application Data

[63] Continuation of Ser. No. 305,251, Nov. 10, 1972, abandoned.

[51] Int. Cl.[2] ..... B22F 3/00

[52] U.S. Cl. ..... 75/247; 75/200; 75/208 R; 75/171; 428/567

[58] Field of Search ..... 29/182.1, 182.5, 182; 75/171, 200, 208, 247; 428/567

[56] References Cited

U.S. PATENT DOCUMENTS

| | | | |
|---|---|---|---|
| 2,159,231 | 5/1939 | Schlecht et al. | 75/200 |
| 2,845,346 | 7/1958 | Scanlon et al. | 75/200 |
| 2,868,667 | 1/1959 | Bowles | 75/171 |
| 2,875,043 | 2/1959 | Tour | 75/171 |
| 2,936,229 | 5/1960 | Shepard | 75/170 |
| 3,494,747 | 2/1970 | Burr | 29/182.1 |
| 3,674,472 | 7/1972 | Kimura et al. | 75/200 |
| 3,802,852 | 4/1974 | Niimi et al. | 29/182.1 |

*Primary Examiner*—Brooks H. Hunt

*Attorney, Agent, or Firm*—Mawhinney & Mawhinney & Connors

[57] ABSTRACT

A process for the manufacture of sintered metal articles includes the steps of selecting a prealloy powder having a composition consisting essentially of 10–18% chromium, 2–6% iron, 2–6% silicon, 2–6% boron, 0.5–2% carbon, balance nickel, mixing the prealloy powder with copper powder in an amount equal to between 20% and 50% of the weight of the total of prealloy powder and copper, preferably adding a small percentage of a suitable lubricant, pressing the mixture to form a compact, and sintering the compact in the range 1050°–1100° C. for such a time that the copper and the nickel-rich prealloy only partly dissolve in one another.

7 Claims, No Drawings

SINTERED METAL ARTICLES

This is a continuation of application Ser. No. 305,251, filed Nov. 10, 1972, now abandoned.

This invention relates to sintered metal articles and to processes for their manufacture.

According to one aspect of this invention, a sintered metal article has a composition consisting essentially of 20–50% copper, 5–14.5% chromium, 1–4.8% iron, 1–4.8% silicon, 1–4.8% boron, 0.1–1.8% carbon, balance nickel, and microstructure of the article being non-homogeneous and having copper-rich regions and nickel-rich regions.

According to another aspect of this invention, a process for the manufacture of sintered metal articles includes the steps of selecting a prealloy powder having a composition consisting essentially of 10 to 18% chromium, 2 to 6% iron, 2 to 6% silicon, 2 to 6% boron, 0.5 to 2% carbon, balance nickel, mixing the prealloy powder with copper powder in an amount equal to between 20% and 50% of the weight of the total of prealloy powder and copper, preferably adding a small percentage of a suitable lubricant, pressing the mixture to form a compact, and sintering the compact in the range 1050°–1100° C. for such a time that the copper and the nickel-rich prealloy only partly dissolve in one another.

Preferably the compact is maintained in the temperature range 1050°–1100° C. for between 15 minutes and one hour.

The material is suitable for articles subjected to high temperatures and stresses. A typical example is a valve seat insert (with which the usual poppet valve cooperates) especially in compression ignition engines. Such valve seat inserts are subjected to temperatures up to 1850° F., and of course wear of the insert would cause leakage when the valve was closed.

At the present time such high-duty materials are cast, for example, from nickel-based and cobalt-based alloys and the so-called "super-alloys", the castings being then machined. Owing to the properties of the materials, such machining is a difficult and expensive orperation. The present invention allows such high-duty materials to be made by powder metallurgy techniques.

It is true that the material has a liquid or semi-liquid phase during the sintering process. However, this is not an important feature, and a competent metallurgist could reasily perform the invention from the description given in the specification. It has been observed that the nickel-based prealloy powder tends to become semi-liquid (of a creamy consistency) in the tunnel furnace, and it is believed, when this semi-liquid phase is reached, the bonding or sintering takes place at an accelerated rate. This results in true alloying occurring during the process, which does not occur when solid phase sintering in which only the surface of each particle softens. As the alloying between the nickel-based prealloy and the copper takes place, the liquefaction temperature increases, and since the furnace temperature is maintained at 1050° to 1100° C., the powder tends again to solidify. It is believed to be this factor which produces the copper-rich and nickel-rich regions, which are only partly dissolved in one another.

A process for the manufacture of sintered alloys in accordance with the invention will now be described by way of example.

A prealloy in the form of a powder of a size to pass through a 100 BS mesh, and having a composition in the following range, is selected (all percentages by weight):

Cr: 10–18%
Fe: 2–6%
Si: 2–6%
B: 2–6%
C: 0.5–2%
Ni: balance.

A typical prealloy has the following composition:

Cr: 14.2%
Fe: 4.8%
Si: 4.2%
B: 3.8%
C: 1.0%
Ni: balance.

This prealloy powder is mixed with copper powder in an amount equal to between 20% and 50% of the weight of the total of the prealloy powder and the copper. Preferably a small percentage, e.g. ½% of the weight of the prealloy powder, of a suitable lubricant, e.g. zinc stearate, is added. The prealloy, copper and lubricant are thoroughly mixed in a suitable mixer.

The mixture is then pressed at 30–45 tons/sq.in. at room temperature in a suitable powder metallurgy press to produce powder compacts, or preforms. These compacts are placed on ceramic plates on a moving mesh belt and passed through a continuous tunnel furnace in a reducing atmosphere, for example an atmosphere of dried cracked ammonia or of pure hydrogen. The temperature gradient of the tunnel furnace is such that the compacts are heated progressively to a temperature in the range 1050°–1100° C, and they are maintained at this temperature for a time preferably between 15 minutes and 1 hour. The compacts then move through a zone of the furnace in which the temperature progressively decreases, the compacts on emerging from the furnace being at a temperature of less than 200° C. The preferred time for which the compacts are maintained in the range 1050°–1100° C. is approximately half an hour.

Sintered parts produced according to the invention in the way just described have a non-homogeneous 2-phase structure, which cannot be produced by casting an alloy of the same nominal composition.

The composition of the sintered parts lies within the following range:

Cu: 20–50%
Cr: 5–14.5%
Fe: 1–4.8%
Si: 1–4.8%
B: 1–4.8%
C: 0.1–1.8%
Ni: 31–67%.

Preferably the composition lies within the following narrower range:

Cu: 35–45%
Cr: 8–10%
Fe: 2–4%
Si: 2–3%
B: 1.5–2.5%
C: 0.5–1.0%
Ni: 35–50%.

A specific example has the following composition:

Cu: 40.0%
Cr: 8.5%
Fe: 2.9%
Si: 2.5%
B: 2.3%

C: 0.8%
Ni: 43.0%.

Sintered parts produced in accordance with the invention have been found to have good thermal conductivity, to retain their hardness at high temperature, and to be relatively malleable.

Typical thermal conductivity of the parts is 0.06% cal/cm$^2$/cm/sec/° C. measured at room temperature.

Both the macro and micro hardness of specimens remained unchanged after soaking for 20 hours at 600° C.; the macro hardness $Hv_{10}$ (Vickers pyramid hardness using 10Kg. load) was 370 at room temperature, and 300 after soaking for 100 hours at 600° C; the micro hardness HV 0.030 (Vickers pyramid hardness using 30g load) was 540 at room temperature, and 500 after soaking for 100 hours at 600° C.

The malleability of the parts is indicated by measurements of elongation in tension. Comparable cast materials have an elongation of less than 1%. Typical specimens of sintered parts in accordance with the invention have an elongation of 2%, measured on a ½ inch gauge length.

The microstructure of the specimens indicated that the copper and nickel-rich prealloy were mutually soluble in one another, but only partly dissolved in one another, resulting in copper-rich regions and nickel-rich regions.

What we claim is:

1. A sintered metal article having a composition consisting essentially of 20–50% copper, 5–14.5% chromium, 1–4.8% iron, 1–4.8% silicon, 1–4.8% boron, 0.1–1.8% carbon, balance nickel, the microstructure of the article being a non-homogeneous 2-phase structure comprising copper-rich regions and nickel-rich regions, said copper-rich regions and nickel-rich regions being formed by partial dissolution of said copper and a nickel-rich prealloy formed from the other components, into each other.

2. A sintered metal article as claimed in claim 1, having a composition consisting essentially of 35–45% copper, 8–10% chromium, 2–4% iron, 2–3% silicon, 1.5–2.5% boron, 0.5–1.0% carbon, and the balance nickel.

3. A sintered metal article as claimed in claim 2 having a composition of substantially 40% copper, 8.5% chromium, 2.9% iron, 2.5% silicon, 2.3% boron, 0.8% carbon, and 43% nickel.

4. A process for the manufacture of sintered metal articles, comprising the steps of selecting a prealloy powder having a composition consisting essentially of 10–18% chromium, 2–6% iron, 2–6% silicon, 2–6% boron, 0.5–2% carbon, balance nickel, mixing the prealloy powder with copper powder in an amount equal to between 20% and 50% of the weight of the total of prealloy powder and copper, adding a small percentage of a suitable lubricant, pressing the mixture to form a compact, and sintering the compact in the range 1050°–1100° C. for such time that the copper and the nickel-rich prealloy only partly dissolve in one another and form a sintered metal article having a non-homogeneous 2-phase structure comprising copper-rich regions and nickel-rich regions.

5. A process as claimed in claim 4, in which the prealloy has a composition of substantially 14.2% chromium, 4.8% iron, 4.2% silicon, 3.8% boron, 1.0% carbon, and balance nickel.

6. A process as claimed in claim 5, in which the compact is maintained in the temperature range 1050°–1100° C. for between 15 minutes and one hour.

7. A process for the manufacture of sintered metal articles, comprising the steps of selecting a prealloy powder having a composition consisting essentially of 10–18% chromium, 2–6% iron, 2–6% silicon, 2–6% boron, 0.5–2% carbon, balance nickel, mixing the prealloy powder with copper powder in an amount equal to between 20% and 50% of the weight of the total of prealloy powder and copper, pressing the mixture to form a compact, and sintering the compact in the range 1050°–1100° C. for such a time that the copper and the nickel-rich prealloy only partly dissolve in one amother and form a sintered metal article having a non-homogeneous 2-phase structure comprising copper-rich regions and nickel-rich regions.

* * * * *

UNITED STATES PATENT OFFICE

CERTIFICATE OF CORRECTION

Patent No. 4198234 Dated April 15, 1980

Inventor(s) Cadle, Terence M.; Lane, Martyn S.; and Johnson, Trevor K.

It is certified that error appears in the above-identified patent and that said Letters Patent are hereby corrected as shown below:

On the Front Page, insert

-- Foreign Application Priority Data

November 20, 1971 Great Britain ..... 54,021/71

Signed and Sealed this

*Eighteenth* Day of *August 1981*

[SEAL]

*Attest:*

GERALD J. MOSSINGHOFF

*Attesting Officer* *Commissioner of Patents and Trademarks*